US005412736A

United States Patent [19]

Keliiliki

[11] Patent Number: 5,412,736

[45] Date of Patent: May 2, 1995

[54] PERSONAL AUDIO SYSTEM AND EARPHONE FOR SAME

[76] Inventor: Shawn P. Keliiliki, 536 S. Commerce Rd. (536), Orem, Utah 84058

[21] Appl. No.: 855,729

[22] Filed: Mar. 23, 1992

[51] Int. Cl.[6] ..... H04R 25/00

[52] U.S. Cl. ..... 381/187; 381/183; 381/68.7

[58] Field of Search ..... 381/187, 154, 169, 68.7, 381/188, 68.6, 205, 151; 379/430

[56] References Cited

U.S. PATENT DOCUMENTS

| | | | |
|---|---|---|---|
| 2,474,135 | 6/1949 | White | 179/182 |
| 2,485,405 | 4/1949 | Olney et al. | 379/430 |
| 2,545,731 | 3/1951 | French | 181/23 |
| 3,513,269 | 1/1967 | Wilson | 381/169 |
| 3,869,584 | 3/1975 | Wilde | 379/430 |
| 4,289,938 | 9/1981 | Zichy | 381/154 |
| 4,529,058 | 2/1985 | Emery | 381/187 |
| 4,727,582 | 2/1988 | de Vries et al. | 381/68.7 |
| 4,791,673 | 12/1988 | Schreiber | 381/151 |
| 4,864,619 | 9/1989 | Spates | 381/188 |
| 4,893,344 | 1/1990 | Tragardh et al. | 379/430 |
| 4,972,468 | 11/1990 | Murase et al. | 379/430 |
| 5,222,151 | 6/1993 | Nagayoshi et al. | 381/68.6 |

FOREIGN PATENT DOCUMENTS

| | | | |
|---|---|---|---|
| 1377237 | 12/1974 | United Kingdom | 381/187 |

*Primary Examiner*—Curtis Kuntz

*Assistant Examiner*—Sinh Tran

*Attorney, Agent, or Firm*—Workman Nydegger & Seeley

[57] ABSTRACT

An earphone (16) is disclosed capable of secure carriage on the ear (18) of a user (12), even during vigorous physical activity. The earphone (16) includes a lightweight audio speaker (40) supported on a flexible, open-looped earpiece ergonomically tailored to cradle the ear (18) without significant resilient deformation. The earphone (16) is made of a hook portion (64) curved to fit against the head (20) of the user (12) over the top of the base (62) of the ear (18). Integrally formed at the forward end (66) thereof is a boom portion (70), which projects downwardly and rearwardly above the tragus (46) to the concha (48) terminating at a remote end (72) from which the speaker (40) is permanently or detachably supported. A curved brace portion (74) integrally formed with the hook portion (64) depends downwardly from the rearward end (68) of the hook portion (64) in close conformity with the back surface (50) of the base (62) of the ear (16) to terminate behind the earlobe (30). An electrical conductor (84) longitudinally disposed within the earphone (16) is electrically connected at one end thereof to the speaker (40). At a point on the earphone (16) below and behind the earlobe (30) the other end of electrical conductor (84) is either permanently or detachably connected through an audio lead (24) to an audio signal source (14).

54 Claims, 6 Drawing Sheets

PERSONAL AUDIO SYSTEM AND EARPHONE FOR SAME

BACKGROUND

1. The Field of the Invention

The invention pertains to personal audio systems and to the earphone or earphones utilized with such systems. More particularly, the invention pertains to an earphone designed for secure carriage on the ear of a user, even during vigorous activity thereby.

2. Background Art

Increasingly, individuals engaged in leisure and work activities are resorting during those activities to the use of audio systems which are carried on the person. These so-called personalized audio systems are capable of providing the user with entertainment, instructions, informational messages, or inter-personal radio communications.

Thus, persons engaged in rigorous activities such as tennis, jogging, racquet ball, skiing, boating, or cycling now frequently carry a source of audio signals, such as a tuner, a tape deck, or a compact disk player, and wear one or more earphones connected to that audio signal source. Naturally, individuals involved in less vigorous activity also benefit from such personalized audio systems when in engaged, for example, in study, vehicular driving, bus or train travel, or the playing of video or table games.

Personal audio systems also find utility in the work environment. There such systems can serve as sources of instruction or even of consoling entertainment. When utilized with a personal radio receiver, such systems can coordinate security precautions, crowd control activities, or maintenance efforts in large buildings, such as factories, schools, warehouses and skyscrapers, or on large land tracts, such as forests, amusement parks, and school campuses. Even the transcription of dictation generally utilizes at least one element of such a personalized audio system, namely the earphone.

The earphone portion of personalized audio systems has, however, not to date been thoughtfully designed, so as to completely fulfill the diverse needs of the individual user.

First, earphones currently in use with personal audio systems are unstable during vigorous physical activity. Sudden movements by the user can detach such earphones from the head, resulting in breakage or in dangerous distractions to the user. The weight, shape and manner of electrically interconnecting such earphones with a source of audio signals result in an earphone which is not stable on the ear or the head of its wearer.

Frequently, tension applied to the earphone by the audio lead with which it is coupled causes the earphone to be dislodged from the head of the user. Even the weight alone of such an audio lead tends to dislodge the audio speaker portion of such earphones from the ear. This is particularly the case where such audio speakers take the form of round relatively light-weight, so-called ear buds, which are merely inserted into the concha of the outer ear. Tension or weight from a audio lead coupled directly to an ear bud will severely destabilize the ear bud and contribute to its undesired dislodgement.

Some efforts toward improving earphone stability have been not only unsuccessful, but have proven to be counter productive by impairing the comfort of the user. Doing so overlooks the willingness of a user to wear the device as a functional design objective.

For example, to securely retain one or a pair of earphones on the head of a user, designers of personal audio systems have resorted to headbands or chin straps. Many such devices are resiliently biased to pinch the head of the user. The aim is to urge the audio speaker into the ear and hold the earphone on the head. Nevertheless, this type of pinching pressure can produce headaches and discomfort to the ear.

Some headbands eliminate such pressures but instead cause the weight of the earphones to rest on the top of the head of the user. This is not a stable arrangement in any activity of the user that is even slightly vigorous. In addition, headbands tend to displace the coiffure of the user or to interfere with the ability of the user to simultaneously wear a hat or a safety helmet.

Generally both headbands and chin straps are deemed unattractive, so that individuals who use them do so only with some reluctance.

The additional weight required for the construction of a headband or a chin strap is weight which will develop dislodging momentum, if the user is involved in vigorous physical activities. Therefore, the weight of the headband or chin strap itself contributes to earphone dislodgement.

Attempts have been to attach an audio speaker directly to the ear of the user, and avoid use of either headbands or chin straps. In one or another fashion, such earphones attempt to stabilize an audio speaker or an ear bud in the concha, but such earphones pinch the outer ear of the user or urge a structural element into the external opening to the auditory canal. The latter is obviously uncomfortable. With sufficient pinching, it may be possible to stably retain the audio speaker of an earphone on the ear of a user. Nevertheless, such pinching is likely to lead to discomfort and headache in a relatively short time.

In large part, earphones for use without headbands or chin straps are made of relatively hard, resilient materials which are not appropriate for use with the soft tissue of the ear. This only exacerbates the discomfort of the pinching action of such designs.

Some earphones which ride directly on the ear of a user are comprised of plural parts that cannot be made resistent to corrosion induced by the sweat of a wearer. These, therefore, are expensive to manufacture and predictably possessed of relatively short lives.

In the ultimate analysis, the earphones used with personal audio systems have prior to the present invention not addressed both the stability and comfort needs of users.

OBJECTS AND SUMMARY OF THE INVENTION

Due to the intimate interaction of the design of the inventive earphone with the ear of a user, it will be useful initially to review the major anatomical features of the ear. Briefly, as used in the present application, the ear will refer to the externally visible auricle, which is attached to the head upstanding therefrom to the rear of the opening to the auditory canal. At the front of the opening to the auditory canal, the auricle includes a promontory-shaped tragus. To the rear of the tragus, communicating with the auditory canal and immediate to the head is the bowl-shaped concha. The back surface of the concha at the head defines the base of the auricle.

The auricle further includes a generally planar fan-shaped scapha, which projects upwardly and rearwardly from the periphery of the concha generally parallel to but a part from the head. The scapha has an upstanding ridge at the outer periphery thereof which is C-shaped and is called the helix. The helix terminates at the lower end thereof in the earlobe and at the upper end thereof in a spine which is directed into the concha above the tragus. These features of a typical ear will be illustrated and identified in the detailed disclosure which eventually follows.

One object of the present invention is to produce a personalized audio system, and in particular an earphone for use with such a system, which is stable on the head of a user, even during vigorous activity thereby.

Another object of the present invention is to produce such an earphone which does not require the use of a headband or chin strap to achieve its stable carriage of an audio speaker at the concha of the ear of a user.

An additional object of the present invention is an earphone as described above which does not resort to the urging action of the resilient deformation of its component parts in order to bring pressure against the head or ear of a user.

Another object of the present invention is an earphone, which is stable during vigorous activity of the user, but in addition which is comfortable to wear.

Yet another object of the present invention is to produce a personalized audio system in which the earphone thereof is not dislodgeable from the ear of the user due to tension applied to an audio lead connected therewith.

Additional objects and advantages of the invention will be set forth in the description that follows and in part will be obvious from the description or may be learned by the practice of the invention. The objects and advantages of the invention may be obtained by means of the instruments and combinations particularly pointed out in the appended claims.

To achieve the foregoing objects described for the present invention, and in accordance with the invention as embodied and broadly described therein, an earphone is provided designed for secure carriage on the ear of a user, even during vigorous physical activity thereby. The earphone comprises a lightweight speaker, and an ear-mountable speaker support therefor. The speaker support is ergonomically tailored to cradle the ear of the user and support the speaker at the opening to the auditory canal.

In one form of the invention, the speaker support comprises a flexible open loop so sized and configured as to extend without significant resilient deformation when worn from a first end thereof, which is worn behind the earlobe in snug engagement with the back of the concha, to a second end thereof which is worn at the concha and which supports the speaker. Between these first and second ends, the speaker support passes about the rear and over the top of the base of the auricle, around the front of the spine of the helix, and above the tragus. When worn, the first and second ends of the loop are disposed in relative close relationship on opposite sides of the concha, and a substantial portion of the length of the loop is positioned behind the scapha interior of the helix.

The speaker support further comprises an audio signal transfer means for electrically coupling the speaker to an audio signal source at a location on the speaker support below and behind the earlobe. As disclosed in one embodiment of the present invention, such an audio signal transfer means comprises a modular electrical connector supported from the first end of the open loop, and an electrical conductor longitudinally disposed within or along the length of the speaker support. The electrical conductor is electrically coupled at its opposite ends to the speaker and to the electrical connector, respectively.

The speaker support may further comprise stress directionalizing means for preventing downward tension on the electrical connector from twisting the speaker support out of position on the ear of the user. In one embodiment, such a stress directionalizing means comprises an arc portion of the speaker support that is disposed between the electrical connector and the second end of the open loop. The arc portion departs radially outward in the plane of the open loop from the curvature thereof. In this manner, the arc portion downwardly supports the electrical connector behind the earlobe in a generally vertical direction when the earphone is worn by the user.

The inventive earphone may optionally comprise personalizing means for reshaping the open loop so as to enable the open loop to more comfortably cradle the ear of the user without significant resilient distortion of the open loop. In one embodiment, the personalizing means comprises an elongated section of a self-sustaining, flexible material embedded longitudinally in the speaker support. The flexible material is deformable under an externally imposed stress, but is in addition capable of retaining the shape into which it is deformed by that stress. In one more specific embodiment, the elongated section of flexible material is cylindrical in shape and is disposed encircling at least a portion of the length of the electrical conductor. By user deformation of the speaker support with the elongated section of flexible material therein, the speaker support may be slightly reshaped by a user, so as to more perfectly fit the ear thereof in a manner that does not impose substantial stress thereupon due to resilient deformation of the speaker support.

The outer surface of the open loop is comprised of an injection molded material which is soft and comfortable to the skin. Examples of such a material include urethane rubber, silicone, vinyl, and thermal rubber.

Optionally, a tab may be provided on the open loop projecting therefrom in a plane parallel to the head of the user in a direction opposite the auricle when the earphone is worn. Such a tab affords user purchase on the open loop at a point intermediate the first and second ends thereof. This facilitates handling of the earphone as it is placed upon and removed from the ear. In this regard, a limited degree of rotational freedom can be afforded to the speaker about an axis coincident with the second end of the open loop to which the speaker is attached.

Alternatively, the inventive earphone may be characterized as comprising a light-weight audio speaker activatable by signals from an audio signal source and a carriage means for supporting the speaker on the ear intimately within the concha and for electrically coupling the speaker to a first end of an audio lead at a location on the carriage means which is behind and below the earlobe when the earphone is worn by the user.

In its essential elements, the carriage means comprises a hook portion curved to fit against the head of the user and over the top of the base of the auricle of the ear. The hook portion has a forward end worn in front of the spine of the helix and a rearward end worn behind the scapha.

A boom portion is integrally formed with the hook portion projecting downwardly and rearwardly from the forward end thereof. The boom portion passes above the tragus when the earphone is worn by the user and terminates in a remote end at the concha where the speaker is supported.

A flexible, curved brace portion is integrally formed with the hook portion depending downwardly from the rearward end thereof. The brace portion conforms closely with the back of the base of the auricle and terminates in a remote end behind the earlobe.

A modular electrical connector, which is matingly coupleable with an audio lead, is supported from the remote end of the brace portion. An electrical conductor longitudinally disposed within the hook portion, the boom portion, and the brace portion is electrically coupled at opposite ends thereof to the speaker and to the electrical connector, respectively.

The inventive earphone may be incorporated singly or in pairs with an audio lead or leads which are themselves electrically interconnectable at a first end thereof with the earphone and a second end opposite thereof with an audio signal source. The interconnection may be selectively and nondestructively disconnectable or may be effected in a permanent manner.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DESCRIPTION OF THE PREFERRED EMBODIMENT

Figure 1:
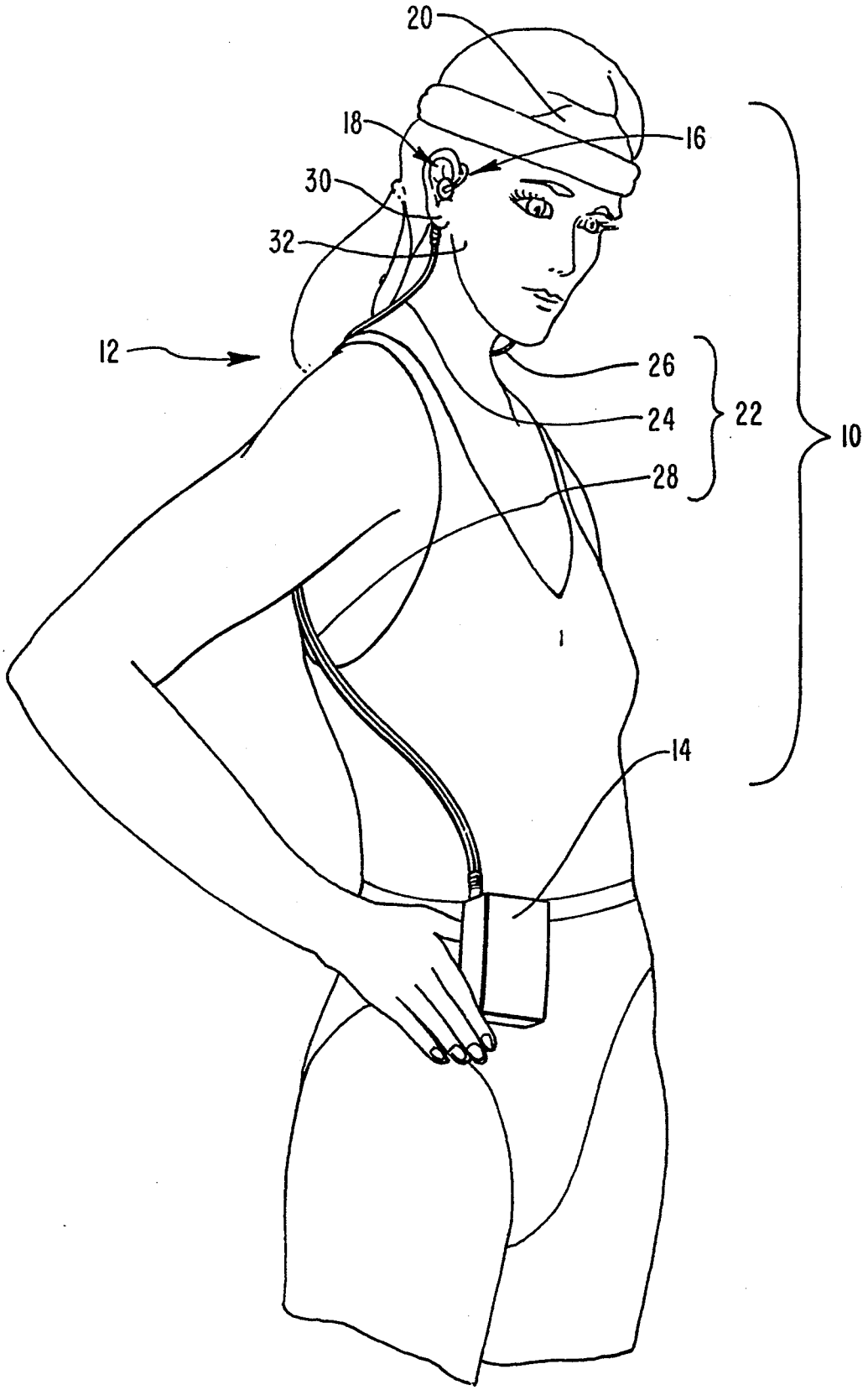
FIG. 1 is an illustration of one embodiment of the inventive personal audio system being worn by a user.

FIG. 1 illustrates a personal audio system 10 incorporating teaching of the present invention and being worn by a user 12 engaged in vigorous physical activity. It should be understood, that while personal audio system 10 is particularly designed with vigorous physical activity of the user in mind, the elements of personal audio system 10 will inherently have utility for users engaged in less vigorous or even sedentary work or leisure activities.

Personal audio system 10 includes an audio signal source 14, such as an AM/FM tuner, a tape deck, a compact disc player, or even a radio receiver/transmitter. Also included in personal audio system 10 is an earphone 16 incorporating teachings of the present invention and thereby being designed for secure carriage on the ear 18 of user 12. Personal audio system 10, as illustrated in FIG. 1, comprises a pair of earphones 16, one of which is not visible in the view contained therein. Nevertheless, whether used singly or in pairs, personal audio system 10 is designed so that earphones 16 remain on ear 18 of user 12, even when head 20 thereof undertakes abrupt or forceful movements in a variety of directions.

In order to provide audio signals from audio signal source 14 to earphones 16, personal audio system 10 includes a Y-cord connector 22. Y-cord connector 22 comprises a pair of audio leads 24 that are individually electrically interconnectable with one of earphones 16, respectively, and a connector stem 28 which is electrically interconnectable to audio signal source 14 and in which the pair of electrical leads 24 are embedded. Audio leads 24 couple to each respective earphone 16 at a location on earphone 16 that is behind the earlobe 30 and jaw 32 of user 12 when earphone 16 is worn by user 12.

Figure 2:
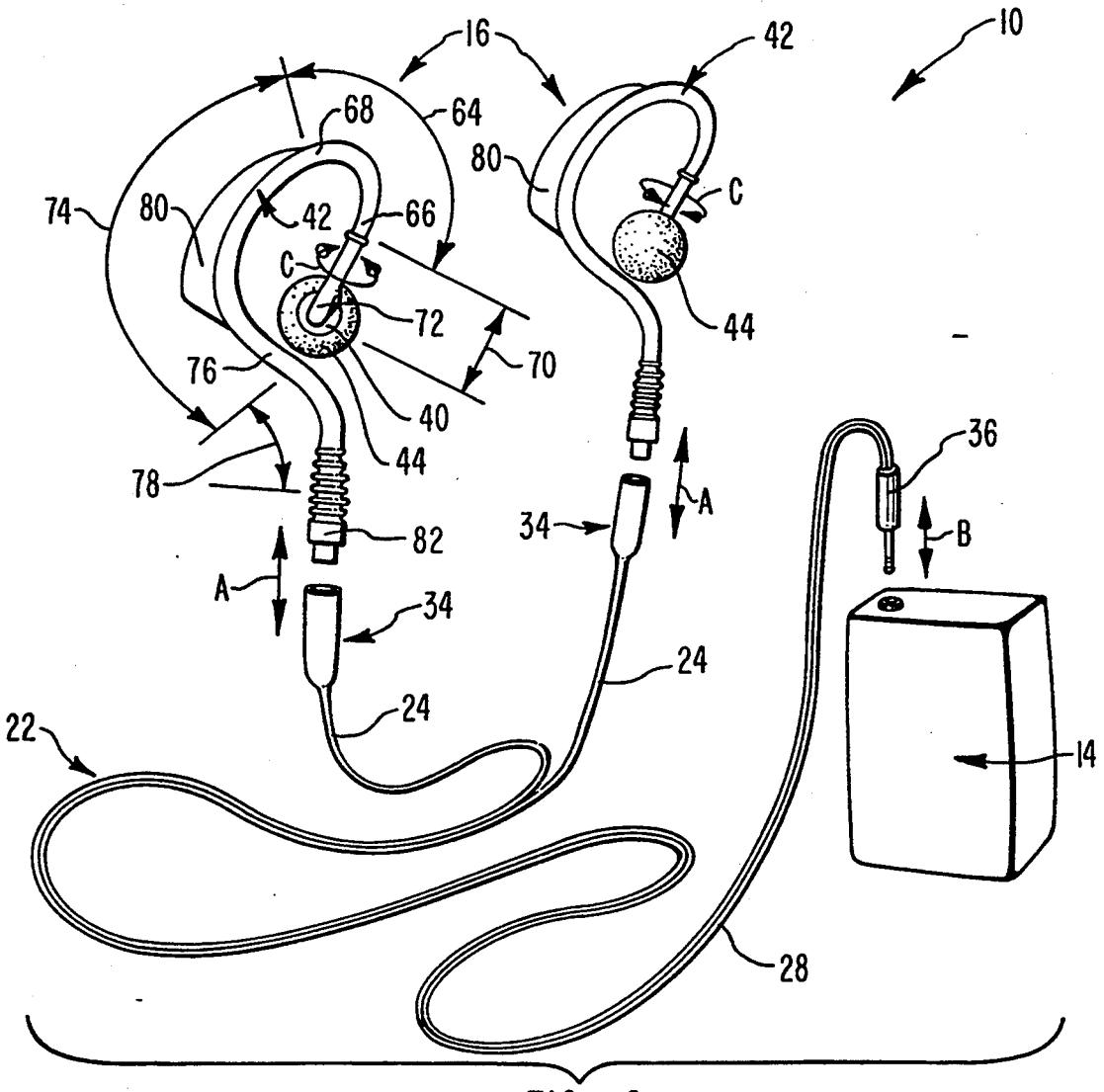
FIG. 2 is a perspective view of the elements of the personal audio system illustrated in FIG. 1.

FIG. 2 illustrates selected aspects of personal audio system 10 in additional detail. As seen therein, a first end 34 of each of the pair of audio leads 24 is nondestructively and selectively disconnectable from a respective one of earphone 16 as shown by arrows A. The second ends 36 of audio leads 24 are embedded in connector stem 28 are correspondingly selectively interconnectable with audio signal source 14 as shown by arrow B.

As illustrated in FIG. 2, each of earphones 16 comprises a lightweight audio speaker 40 supported at one end of an integral flexible earpiece 42. Speaker 40 is preferably of such a size as to be receivable in the concha of the ear of a user, and may thus be the type of speaker frequently referred to as an ear bud. In order to increase the comfort of the speaker 40 in the concha of the ear of a user, speaker 40 may be enclosed by a removable cover 44 comprised of foam rubber.

Preferably, speaker 40 has a frequency range of 16,000 to 22,000 Hertz, an impedance from about 16 to 32 ohms, and a sensitivity in the range from about 92 to 106 decibels. An impedance of 16 ohms and a sensitivity of 104 decibels have been adopted for optimum audio fidelity.

To facilitate the fitting of speaker 40 into the concha of the ear, speaker 40 may be provided with a limited range of rotational freedom about an axis coincident with the end of earpiece 42 to which speaker 40 is attached. This is indicated by arrow C in FIG. 2. It should be noted, that the flexibility of the earpiece 42 also contributes to the easy fitting of speaker 40 into the ear of the user, but that the earpiece 42 when worn by user is designed to conform without significant resilient deformation to the ear thereof.

Figure 3:
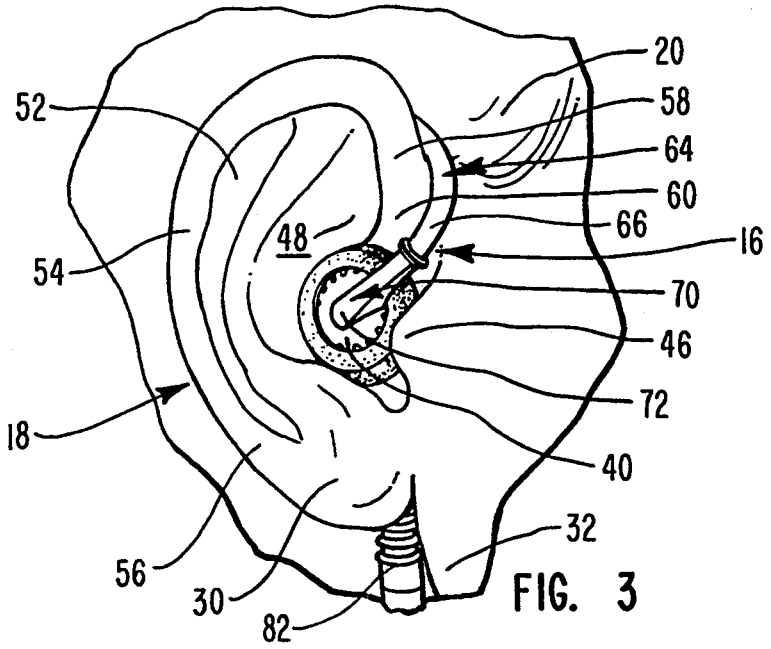
FIG. 3 is a side view of the head and ear of a user of an inventive earphone of the personal audio system illustrated in FIG. 2.
Figure 4:
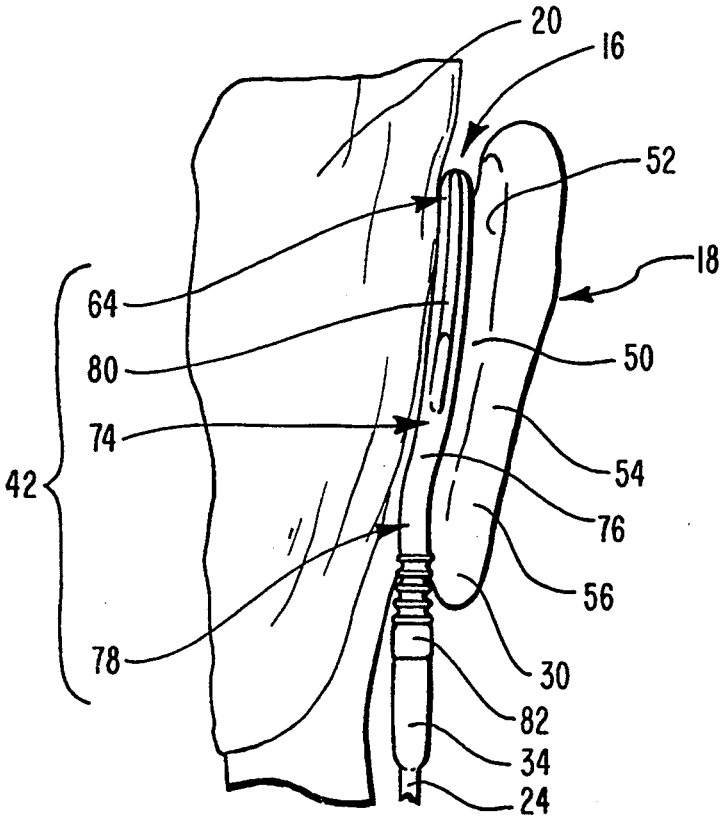
FIG. 4 is a view from the rear of the head of a user of the inventive earphone illustrated in FIG. 3.

Before describing in detail each of the constituent elements of earpiece 42, it will be useful to discuss the anatomical structure of the typical ear 18 of a user. This can best be undertaken in relation to FIG. 3, showing a side view of a typical ear 18, and FIG. 4, showing a view of a typical ear 18 from the rear of head 20. As used herein, ear 18 should be understood to refer generally to the externally visible auricle which is attached to and upstanding from head 20 to the rear of the opening to the auditory canal.

As seen in FIG. 3, the actual opening to the auditory canal is obscured, both by speaker 40 and by the promontory-shaped tragus 46 located at the front of the opening to the auditory canal. Tragus 46 constitutes the most forward portion of the auricle or ear 18. To the rear of tragus 46 auricle or ear 18 includes a bowl-shaped concha 48 which communicates with the auditory canal and is located immediate to head 20. The back surface 50 FIG. 4 of concha 48 defines the base of auricle or ear 18.

A generally planar fan-shaped scapha 52 projects upwardly and rearwardly from the periphery of concha 48 parallel to and apart from head 50. Scapha 52 is encircled at the outer perimeter thereof by an upstanding ridge-like helix 54 which in FIG. 3 assumes a general C-shape. Helix 54 terminates at the lower end 56 thereof in earlobe 30 and at the upper end 58 thereof in a spine 60 directed into concha 48 above tragus 46.

Figure 5:
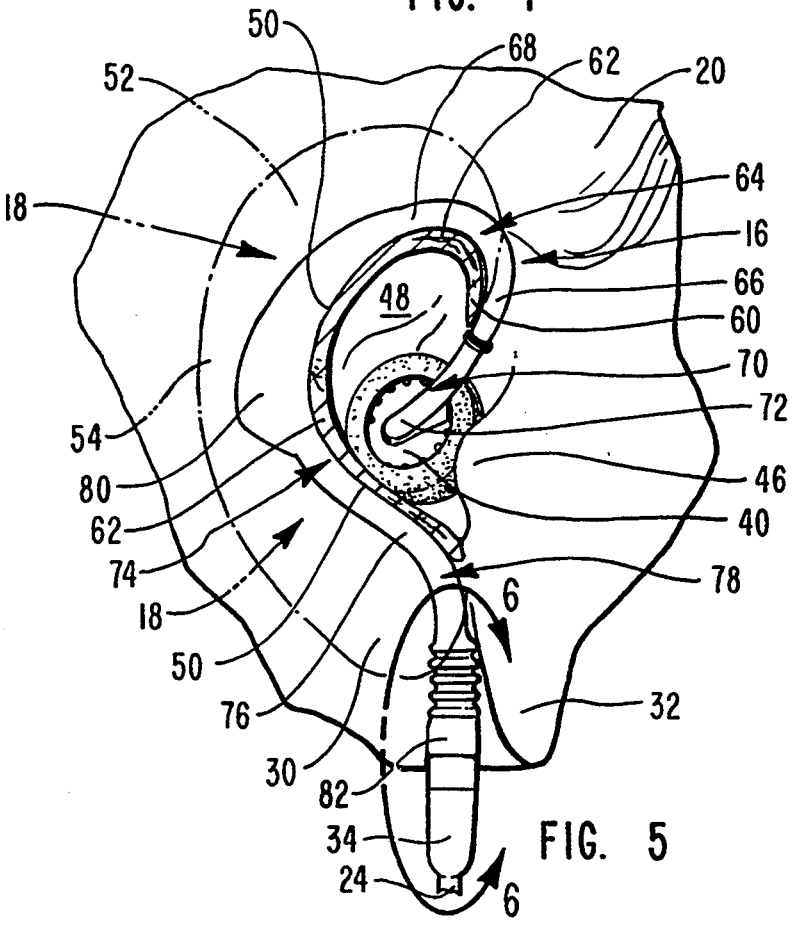
FIG. 5 is a side view of the inventive earphone illustrated in FIG. 3 with the base of the ear of the user shown in cross section and the outline of the ear of the user shown in phantom, thereby to more clearly illustrate the interaction of the inventive earphone with the base of the auricle of the user.

FIG. 5 is a side view of auricle or ear 18 similar to that shown in FIG. 3. Nevertheless, in order to more completely communicate the nature of the interaction of integral ear piece 42 with the anatomical elements of ear 18, the base 62 of ear 18 between concha 48 and rear surface 50 thereof appears in cross section, while the outline of ear 18 and certain elements such as earlobe 30, helix 54, and scapha 52, are shown in phantom.

Returning to FIG. 2, integral earpiece 42 will be seen to comprise a hook portion 64 having a forward end 66 and a rearward end 68. Integrally formed with forward end 66 of hook portion 64 is boom portion 70 of integral ear piece 42 which terminates in a remote end 72 where speaker 40 is supported. Integrally formed to rearward end 68 of hook portion 64 is a downwardly depending curved brace portion 74 having a remote end 76. At remote end 76 brace portion 74 is an arc portion 78 of integral earpiece 42 which departs radially outwardly in the plane of brace portion 74 from the curvature thereof.

As best understood by reference to FIGS. 3, 4 and 5 taken together, hook portion 64 of earpiece 42 is curved to fit against head 20 of the user around the rear and over the top of base 62 of the auricle or ear 18. Forward end 66 of hook portion 64 is worn in front of spine 60 of helix 54, while rearward end 68 of hook portion 64 is worn behind scapha 52 in contact with rear surface 50 of concha 48. Boom portion 70 projects downwardly and rearwardly from forward end 66 of hook portion 64 passing above tragus 46 to terminate at a remote end 72 thereof. Brace portion 74 conforms closely with base 62 of ear 18, contacting the back surface 50 of concha 48. Remote end 76 of brace portion 74 terminates behind earlobe 30 in contact with rear surface 50 of concha 48.

In this light, earpiece 42 will be appreciated to be an ear-mountable speaker support which is ergonomically tailored to cradle ear 18 of the user. The speaker support comprises a flexible open loop, formed substantially in a single plane. The loop is so sized and configured as to rest freely against the head, conforming to the shape of the base of the auricle. The plane defined by the loop is generally parallel to the head and is free of forces urging the loop away from the head. The loop extends without significant resilient deformation within the plane of the loop from a first end worn behind the earlobe 30 in snug engagement with base 62 of ear 18 contacting back surface 50 of concha 48 to a second end thereof worn at concha 48 from which second end speaker 40 is supported. The open loop of earpiece 42 between the first and second ends thereof passes about the rear and over the top of base 62 of the auricle or ear 18, around the front of spine 60 of helix 54, and above tragus 46. In this manner, a substantial portion of the length of earpiece 42 is positioned when worn behind scapha 52 interior of helix 54.

The opposite ends of this open loop are disposed in relative close relationship on opposite sides of concha 48 when earpiece 42 is worn by the user. This relationship between opposite ends of earpiece 42 and the anatomy of ear 18 of a user is best appreciated by reference to FIG. 5. Again, it should be emphasized that in the wearing, earpiece 42 imposes slight, if any, pressure on ear 18 or head 20 of the user due to any resilient deformation of earpiece 42.

Optionally, according to one aspect of the present invention, an earpiece, such as earpiece 42, is provided with handle means for affording a user of earphone 16 ready purchased thereon at a point intermediate the opposite ends of earpiece 42. As shown by way of example and not limitation in FIG. 2, a tab 80 projects from base portion 74 of earpiece 42 in a plane parallel to head 20 of the user in a direction opposite auricle or ear 18 when earphone 16 is worn. Any number of structures equivalent to tab 80 can be secured to one or another of the portions of earpiece 42 between the extreme ends thereof in order to perform the function of the handle means. Such structures could include solid tabs of various shapes, projections such as rings or hooks provided with open or closed apertures, or even non-rigid extensions made of, for example, mesh or fabric.

According to another aspect of the present invention, an earphone, such as earphone 16 includes audio signal transfer means for electrically coupling speaker 40 to an audio signal source at a location on earpiece 42 below and behind earlobe 30. As shown by way of example in FIG. 5, and in additional detail in FIG. 6, a modular electrical connector 82 is supported by arc portion 78 of earpiece 42 from remote end 76 of brace portion 74. Electrical connector 82 is matingly coupleable with first end 34 of either of audio leads 24 illustrated in FIGS. 1 and 2.

In addition, an electrical conductor 84 (shown in FIGS. 6 and 7) is longitudinally disposed within earpiece 42 extending from remote end 72 of boom portion 70 to remote end 76 of brace portion 74. Electrical conductor 84 is electrically coupled at opposite ends thereof to speaker 40 and to electrical connector 82, respectively. Electrical connector 82 is optionally smaller than a standard modular audio connector. Electrical connector 82 thus preferably takes the form of a so-called sub-mini-mini phone jack commercially available from the Radio Corporation of America (RCA).

Significantly, it is the function of the above-described audio signal transfer means to permit any audio lead that is to be coupled to earphone 16 to be attached to the structure by which speaker 40 is supported on ear 18 of a user at a location below and behind earlobe 30 thereof. In this manner, stress imposed on that support structure by the audio lead coupled thereto will not tend to detach speaker 40 from ear 18. Instead, by virtue of the ergonomic tailoring of earpiece 42, such stresses will tend to be borne by the entire auricle or ear 18, leaving speaker 40 secure in concha 48 at the opening to the auditory canal.

A number of structures equivalent to those described above as performing the function of the signal transfer means. These would include any type of electrical connector supported at remote end 76 of brace portion 74 in combination with an electrical conductor which disposed internally or even externally along the length of earpiece 42 from speaker 40 to a location behind and below earlobe 30. The electrical connector utilized need not be selectively decoupleable from its corresponding audio lead, but may be integrally and permanently fabricated therewith, as will be illustrated in subsequent embodiments of the inventive personal audio system.

The beneficial effects of audio signal transfer means can be enhanced by providing earpiece 42 with stress directionalizing means for preventing downward tension on electrical connector 82 from twisting earpiece 52 out of position on ear 18 of the user. As best seen in FIG. 5, arc portion 78 is disposed between electrical connector 82 and remote end 76 of brace portion 74. As arc portion 78 departs outwardly from the curvature of brace potion 74, arc portion 78 supports electrical connector 82 downwardly behind earlobe 30 in a generally vertical orientation when earphone 16 is worn by a user. As a result, tension on audio lead 24 is communicated to earpiece 42 in a correspondingly, downward vertical direction, which is absorbed in an optimum and total manner by ear 18. This maintains the position of speaker 40 in concha 48.

The downward vertical direction is the most likely direction in which stress from an audio lead used in a personal audio system will be applied to earpiece 42. As first end 34 of audio lead 24 is selectively decoupleable from electrical connector 82, the downward orientation of electrical connector 82 will encourage decoupling of first end 34 of audio lead 24, rather than incurring damage to either audio lead 24 or to earpiece 42. Naturally, where audio lead 24 is permanently secured to earpiece 42, this advantage to the orientation of electrical connector 82 will not be available.

In accordance with another aspect of the present invention, earpiece 42 may be provided with safety means for flexibly absorbing stress imposed on electrical connector 82 by an audio lead coupled therewith. As illustrated in detail in FIG. 6, a housing 86 encircles electrical connector 84 at the end thereof adjacent to arc portion 78 of earpiece 42. Housing 86 has an outer surface 88 with a diameter that is greater than the diameter of outer surface 90 of arc portion 78. In addition, outer surface 88 of housing 86 comprises a plurality of upstanding ridges 92 which encircle housing 86.

The enhanced mass of housing 86 relative to that of arc portion 78 tends to absorb stresses imposed on electrical connector 82 by any audio lead coupled therewith. Where the stresses are not directed along the longitudinal vertical oriented axis of electrical connector 82, ridges 92 afford a degree of flexibility between electrical connector 82 and arc portion 78. This permits those stresses to be absorbed without rotating earpiece 42 on ear 18 of the user. Ridges of virtually any configuration in combination with a large mass surrounding the end of electrical connector 82 adjacent to arc portion 78 of earpiece 42 can accomplish the function of the safety means.

The earphone of the present invention alternatively can be viewed as the combination of a lightweight audio speaker activated by signals from a audio signal source and a carriage means for supporting the speaker on the ear intimately within the concha and for electrically coupling the speaker to an audio lead from the audio source at a location on the carriage means which is behind and below the earlobe when the earphone is worn by the user. As shown by way of example and not limitation in FIG. 2, such a carriage means comprises hook portion 64 of earpiece 42 integrally formed with boom portion 70 and brace portion 74 thereof. An electrical conductor, such as electrical conductor 84 shown in FIGS. 6 and 7, extends along the length of earpiece 42 and is electrically coupled at opposite ends thereof to a speaker, such as speaker 40 supported at remote end 72 of boom portion 70, and an electrical connector supported at remote end 76 of brace portion 74.

Figure 6:
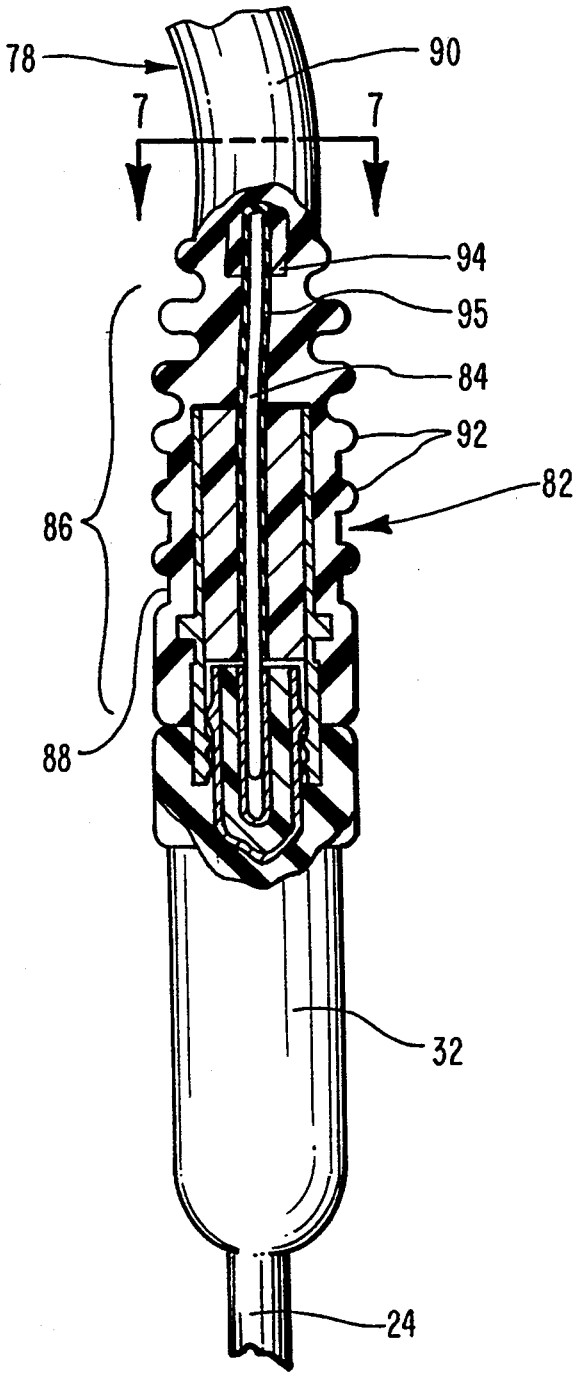
FIG. 6 is an enlarged break-away view of the housing of the electrical connector associated with the inventive earphone illustrated in FIG. 5.

Modular electrical connector 82 as shown in FIGS. 5 and 6 is but one decoupleable form of such an electrical connector. A permanent electrical coupling of an audio lead with electrical conductor 84 at remote end 76 of brace portion 74 would readily fulfill the function of the carriage means described above. This would be the case, whether or not the form of the electrical connector utilized therewith is advantageously oriented ill a vertical position at remote end 76 of brace portion 74 through the interposition therebetween of a structure, such as arc portion 48. By reference to FIGS. 3 and 5, it will be appreciated that a substantial portion of the length of the carriage means described above is disposed behind scapha 52 of the auricle or ear 18 inside helix 54 when the inventive earphone is worn.

The exterior of earpiece 42 may be fabricated about the internal components thereof using injection molding techniques. The material utilized should preferably be soft and comfortable to the skin regardless of the internal elements of earpiece 42. Examples of materials suitable for the exterior of earpiece 42 are urethane rubber, silicone, vinyl and thermo rubber.

The composite structure of this molded material and any internal elements of earpiece 42 should be flexible, so as to facilitate fitting of earpiece 42 in a cradling relationship about ear 18 of a user.

Earpiece 42 is to be configured so as to extend in its a course about base 62 of ear 18 without significant resilient deformation. It is the close conforming of earpiece 42 to base 62 of ear 18 which provides the primary mechanism for securing earpiece 42 on the ear of a wearer during vigorous physical activity. It is not intended that significant unrelieved resilient deformation of earpiece 42 be used to urge earpiece 42 against portions of ear 18, as such tensions imposed upon ear 18 can cause discomfort to a user.

Nevertheless, as the size and shape of the ear may vary among users, a slight amount of resilient deformation may exist after earpiece 42 has been fitted to ear 18 of a user. This may result in some small degree of pressure to portions of ear 18. Nevertheless, an earpiece 42 is considered to be within the scope of the teachings of the present invention, where pressures to ear 18 from the resilient deformation thereof are relatively minor in maintaining the stable position of speaker 40 at concha 48 when compared to the ergonomic tailoring of earpiece 42.

Figure 7:
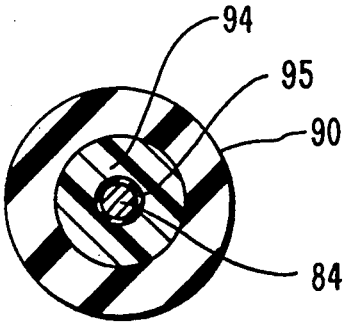
FIG. 7 is a cross sectional view of the end of the inventive earphone illustrated in FIGS. 3–5 taken along section line 7—7 shown in FIG. 6.

According to yet another aspect of the present invention, earpiece 42 may optionally be provided with personalizing means for reshaping the open loop of earpiece 42 so as to enable earpiece 42 to more perfectly cradle ear 18 of a user without significant resilient distortion of earpiece 42. As shown by way of example and not limitation in FIGS. 6 and 7, an elongated section 94 of a self-sustaining, flexible material is embedded longitudinally in earpiece 42. The flexible material of which elongated section 94 is comprised is deformable under an externally imposed stress and is capable of retaining the shape into which it is deformed by that stress. As shown in FIGS. 6 and 7, elongated section 94 is cylindrical in shape and is disposed encircling at least a portion of the length of electrical conductor 84.

A structure such as elongated section 94 may be embedded along all or merely a portion of the length of earpiece 42 in order to perform the function of the personalizing means. It may for convenience of manufacturing be advantageous to so surround electrical conductor 84 with elongated section 94, using elongated section 94 as the electrical insulation therefor. Nevertheless, as shown in FIGS. 6 and 7, electrical conductor 84 is provided in addition to elongated section 94 with a relatively thin external electrical insulator 95.

By selective bending of an earpiece, such as earpiece 42, in which is embedded a structure performing the function of the personalizing means, slight adjustments can be effected by a user in the shape in the open loop of earpiece 42 before earpiece 42 is donned. By this mechanism, the resilient pressure imposed upon ear 18 of the user by earpiece 42 can be minimized.

In order to perform the function of the above-described personalizing means, it is not necessary that a section of material of the type described as comprising elongated section 94 encircle electrical connector 84 or necessarily extend the full length of earpiece 42. Instead, any elongated portion of such a material can be disposed within the body of earpiece 42 parallel to electrical conductor 84. Such a material can be limited in its extent to portions of earpiece 42, such as to the lower end of brace portion 74 or to arc portion 78.

Thus, by careful attention to the shaping of earpiece 42 an earphone, according to the present invention, is provided which can be securely carried on the ear and on the ear alone during vigorous activity. The inventive earpiece is designed to apply insignificant pinching stress, either on the ear or the head of the user. The inventive earpiece relies instead upon close conformity of the earpiece to the base of the ear in order to maintain the stability of an earphone at the opening of the auditory canal. In this respect, the routing of electrical connections to the speaker through earpiece, so that coupling of audio leads thereto occurs on the earpiece at a position below and behind the earlobe is additionally advantageous. By this type of connection, no stress from such an audio lead is imposed directly on the speaker, and the speaker is buffered from the dislodging action of such stresses.

The inventive earphone described above can be individually or in pairs incorporated into a personalized audio system on a modularly coupleable basis, such as is illustrated in FIG. 2. Alternatively, the inventive earphone can be incorporated into permanent, unitary structures such as are shown in FIGS. 8 or 9.

Figure 8:
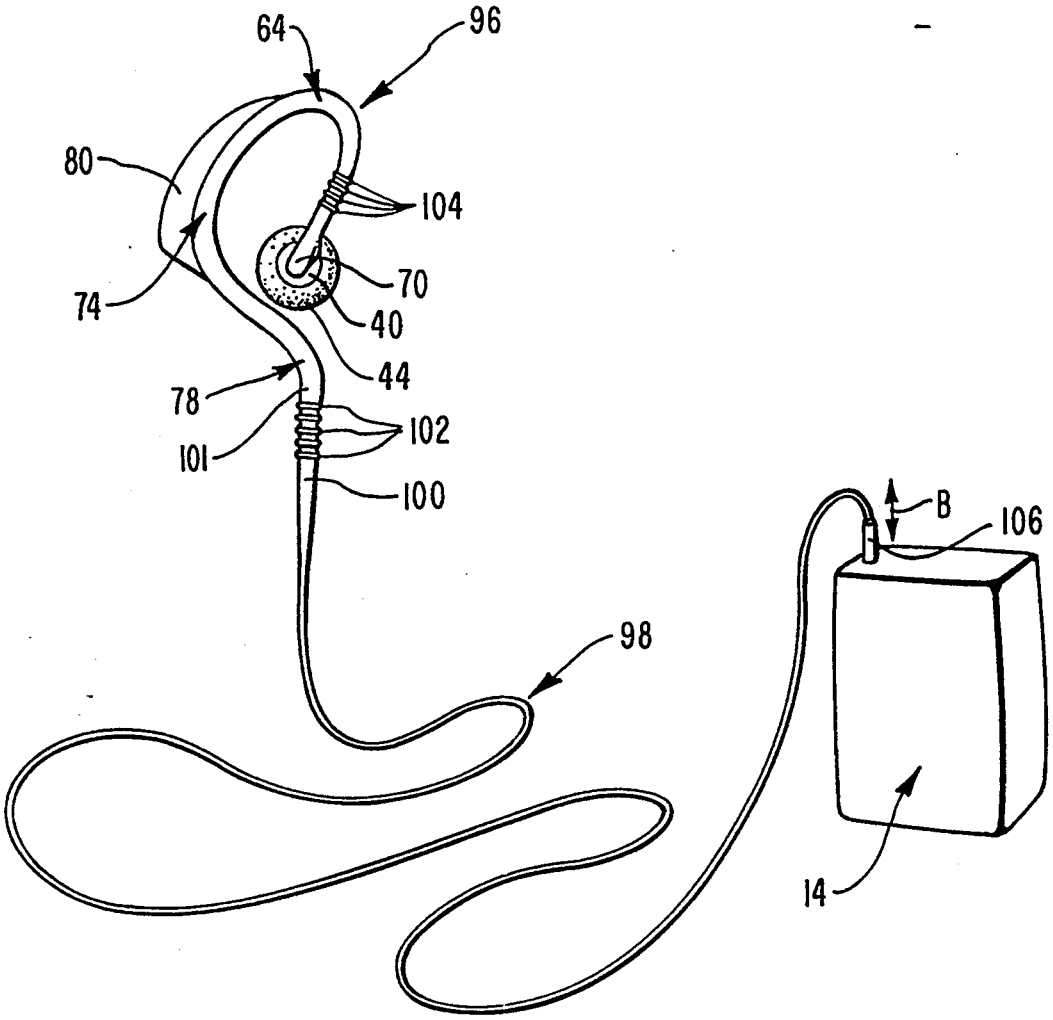
FIG. 8 is a perspective view of the elements of a personal audio system incorporating a single inventive earphone.

In FIG. 8 an earphone 96, similar in most respects to earphone 16 shown in FIG. 2, has been permanently connected to an audio lead 98 at a first end 100 thereof. Accordingly, first end 100 of audio lead 98 is coupled directly to arc portion 78 without the interposition of any enlarged electrical connector, such as electrical connector 82 shown in FIG. 6. Nevertheless, in order to afford a degree of flexibility to the end 10 of arc portion 78 which is attached to audio lead 98, end 10 of arc portion 78 is provided with a plurality of upstanding and encircling ridges 102 similar to ridges 92 shown in FIG. 6.

In addition, earphone 96 has been provided on the exterior of boom portion 70 with a plurality of ridges 104, similar in appearance to ridges 92 illustrated in FIGS. 5 and 6. Ridges 102 and 104 function in substantially in the same manner as ridges 92 to absorb stress imposed on the structure supporting speaker 40 toward the end of maintaining the stability of speaker 40 in concha 48. The second end 106 of audio lead 98 is, as in previous embodiments of the inventive system, selectively coupleable from audio signal source 14, as shown by arrow B.

Figure 9:
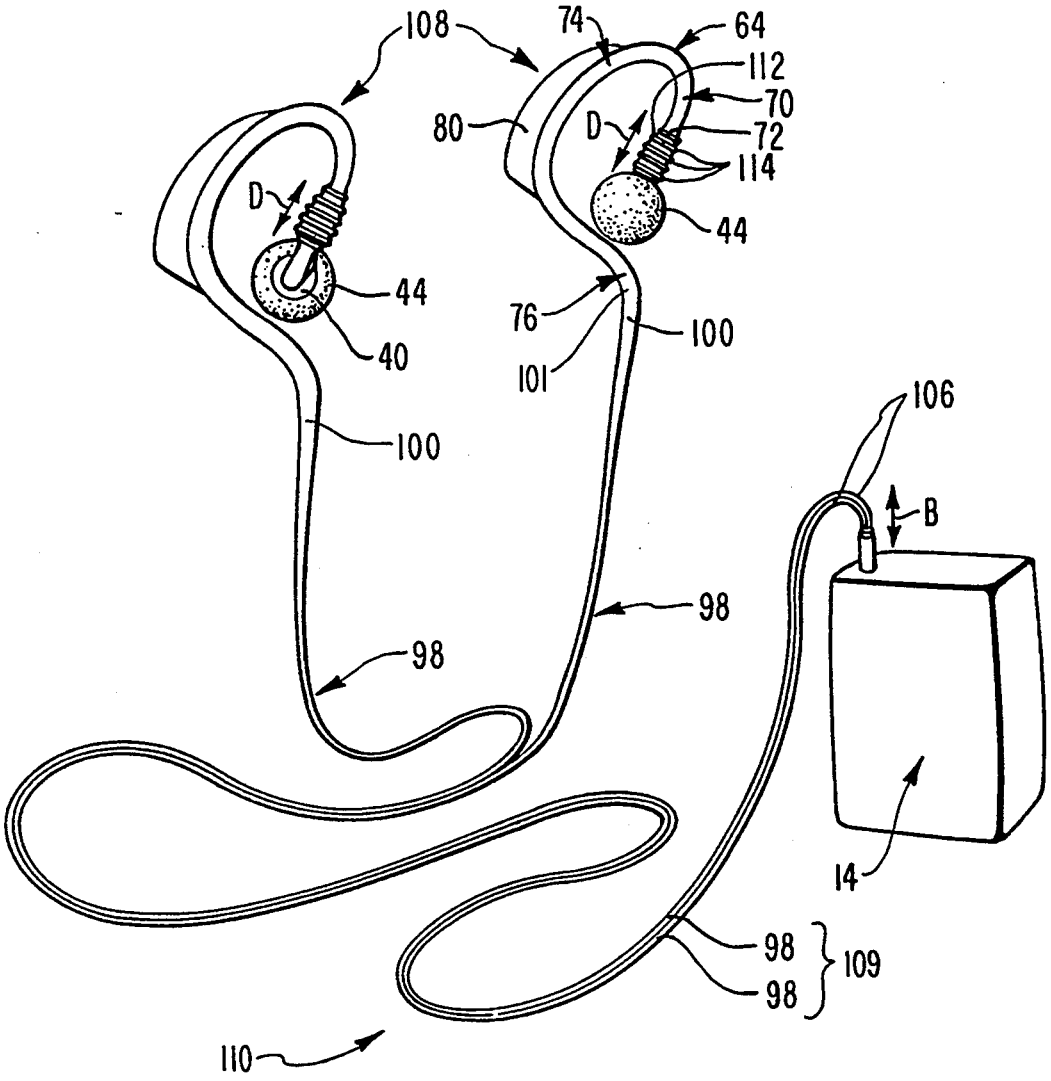
FIG. 9 is a perspective view of a personal audio system incorporating a pair of inventive earphones.

In FIG. 9, a pair of earphones 108, similar in most respects to earphone 16 shown in FIG. 2, are permanently coupled to the individual leads of a pair of audio leads 98 at first ends 100 of each. In the case illustrated, however, end 101 of each of arc portions 78 adjacent to audio leads 98 have been configured in a streamlined fashion free of ridges, such as ridges 102 shown in FIG. 8. The second ends 106 of audio leads 98 are joined together to form connector stem 109 of a Y-cord connector 110. Second ends 106 of audio leads 98 are selectively detachable from audio signal source 14, as indicated by arrow B.

The audio system illustrated in FIG. 9, however, differs from those previously disclosed in that remote end 72 of boom portion 70 terminates in an electrical connector 112 similar in structure and function to electrical connector 82 shown in FIG. 6. The use of electrical connector 112 permits speaker 40 to be selectively and non-destructively uncoupled therefrom as indicated by arrow D. Speaker 40 may thus be modularly removed for replacement by a speaker having alternative performance characteristics or in order to be repaired or replaced, if defective. The exterior of electrical connector 112 may be provided with encircling upstanding ridges 114 provided toward the same end as ridges 92 illustrated in FIG. 6.

The invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An earphone designed for secure carriage on the ear of a user during vigorous activity thereby, the ear of the user being the externally visible auricle upstanding from the head to the rear of the opening to the auditory canal, the auricle including a promontory-shaped tragus at the front of the opening to the auditory canal and a bowl-shaped concha to the rear thereof communicating with the auditory canal and being located immediate to the head, the back surface of the concha at the head defining the base of the auricle, the auricle further including a generally planar scapha projecting upwardly and rearwardly from the periphery of the concha generally parallel to and apart from the head, the scapha being encircled at the outer perimeter thereof by an a upstanding ridge-like helix, the helix terminating at the lower end thereof in the earlobe and at the upper end thereof in a spine directed into the concha above the tragus, said earphone comprising:

(a) a light-weight audio speaker; and (b) an ear-mountable speaker support integrally formed and ergonomically tailored to cradle the ear of the user, said speaker support comprising a flexible open loop, formed substantially in a single plane, said loop being so sized and configured as to rest freely against the head conforming to the shape of the base of the auricle with said plane of said loop being generally parallel to the head free of forces urging said loop away from the head, said loop extending without significant resilient deformation within said plane of said loop from a first end worn behind the earlobe in snug engagement with the back surface of the concha, to a second end supporting said speaker and worn at the concha, said open loop between said first and second ends thereof passing about the rear and over the top of the base of the auricle, around the front of the spine of the helix, and above the tragus positioning a substantial portion of the length of said open loop behind the scapha interior of the helix wherein said speaker support further comprises audio signal transfer means for electrically coupling said speaker to an audio signal source at a location on said speaker support below the earlobe between the earlobe and the head.

2. An earphone as recited in claim 1, wherein said first and second ends of said open loop are disposed in relative close relationship on opposite sides of the concha when said earphone is worn by the user.

3. An earphone as recited in claim 2, wherein the exterior of said open loop is comprised of a material which is soft and comfortable against the skin.

4. An earphone as recited in claim 1, further comprising handle means for affording a user of said earphone ready purchase on said speaker support at a point intermediate said first and second ends of said open loop.

5. An earphone as recited in claim 4, wherein said handle means comprises a tab projecting from said open loop between the scapha and the head in a plane parallel to the head of the user in a direction away from the back surface of the base of the auricle when said earphone is worn by the user.

6. An earphone as recited in claim 1, wherein said audio signal transfer means comprises:

(a) a modular electrical connector supported from said first end of said open loop; and (b) an electrical conductor longitudinally disposed within said speaker support extending from said first to said second end thereof, said conductor being electrically coupled at opposite ends thereof to said speaker and to said electrical connector, respectively; and wherein said speaker support further comprises stress directionalizing means for preventing downward tension on said connector from twisting said speaker support out of position on the ear of the user.

7. An earphone as recited in claim 1, wherein said speaker support further comprises personalizing means for reshaping said open loop so as to enable said open loop to more comfortably cradle the ear of the user without significant resilient distortion of said open loop.

8. An earphone as recited in claim 7, wherein said personalizing means comprises an elongated section of a self-sustaining, flexible material embedded longitudinally in said speaker support, said flexible material being deformable under an externally imposed stress and being capable of retaining the shape into which said flexible material is thereby deformed.

9. An earphone as recited in claim 8, wherein said elongated section of said self-sustaining flexible material is cylindrical in shape and is disposed encircling at least a portion of the length of said audio signal transfer means.

10. An earphone as recited in claim 1, wherein said audio signal transfer means comprises:

(a) an arc portion of said open loop integrally formed with said brace portion at said remote end thereof, said arc portion departing radially outward in the plane of said brace portion from the curvature of said brace portion, thereby to terminate in a downwardly oriented direction between the earlobe and the head;

(b) an electrical conductor longitudinally disposed within said speaker support extending from said second end to said first end thereof and therebeyond longitudinally through said arc portion thereof, said electrical conductor being electrically coupled at a first end thereof to said speaker and having a second end opposite therefrom; and (c) an audio lead electrically interconnectable at a first end thereof with said second end of said electrical conductor and at a second end opposite thereto with an audio signal source.

11. An earphone as recited in claim 10, wherein said first end of said audio lead is permanently connected to said second end of said electrical connector.

12. An earphone as recited in claim 1, wherein said audio signal transfer means comprises:

(a) an arc portion of said open loop integrally formed with said brace portion at said remote end thereof, said arc portion departing radially outward in the plane of said brace portion from the curvature of said brace portion, thereby to terminate in a downwardly oriented direction between the earlobe and the head; and (b) an electrical conductor longitudinally disposed within said speaker support extending from said second end to said first end thereof and therebeyond longitudinally through said arc portion thereof, said electrical conductor being electrically coupled at a first end thereof to said speaker and having a second end opposite therefrom, said second end of said electrical conductor being electrically interconnectable through an end of the audio lead to the audio signal source.

13. An earphone as recited in claim 12, wherein said second end of said electrical connector is permanently connected to the audio lead.

14. An earphone for use with an audio lead from an audio signal source and designed for secure carriage on the ear of a user during vigorous activity thereof, said earphone comprising:

(a) a light-weight audio speaker activatable by signals from the audio signal source; and (b) carriage means for supporting said speaker on the ear intimately within the concha and for electrically coupling said speaker to a first end of the audio lead at a location on said carriage means below the earlobe between the earlobe and the head when said earphone is worn by the user, thereby preventing dislodgement of said speaker from the ear of the user due to tension applied to the carriage means by the audio lead.

15. An earphone as recited in claim 14, wherein said carriage means comprises:

(a) a hook portion curved to fit against the head of the user and over the top of the base of the auricle of the ear, said hook portion having a forward end worn in front of the spine of the helix and a rearward end worn behind the scapha;

(b) a boom portion integrally formed with said hook portion projecting downwardly and rearwardly from said forward end thereof, said boom portion passing above the tragus when said earphone is worn by a user and terminating in a remote end at the concha, said speaker being supported at said remote end of said boom portion;

(c) a flexible, curved brace portion integrally formed with said hook portion depending downwardly from said rearward end thereof, said brace portion conforming closely with the back of the base of the auricle and terminating in a remote end behind the earlobe;

(d) a modular electrical connector matingly coupleable with an audio lead and supported from said remote end of said brace portion; and (e) an electrical conductor longitudinally disposed within said hook portion, said boom portion, and said brace portion extending from said remote end of said boom portion to said remote end of said brace portion, said electrical conductor being electrically coupled at opposite ends thereof to said speaker and to said electrical connector, respectively.

16. An earphone as recited in claim 15, wherein said speaker is afforded a limited degree of rotational freedom about an axis coincident with said remote end of said boom portion of said carriage means, thereby to facilitate placement of said earphone on the ear of the user and fitting of said speaker into the concha.

17. An earphone as recited in claim 15, wherein said speaker comprises an ear bud so sized as to be receivable in the concha of the ear of a user.

18. An earphone as recited in claim 15, wherein the outer surface of said remote end of said boom portion of said carriage means comprises a plurality of upstanding ridges encircling said boom portion.

19. An earphone as recited in claim 14, wherein said carriage means further comprises an arc portion integrally formed with said brace portion at said remote end thereof, said arc portion departing radially outwardly in the plane of said brace portion from the curvature of said brace portion and having said electrical conductor disposed therewith, thereby to downwardly support said electrical connector below the earlobe in a generally vertical orientation between the earlobe and the head when said earphone is worn by the user.

20. An earphone as recited in claim 14, wherein substantially all of said carriage means is concealed by the auricle when worn by the user.

21. An earphone as recited in claim 14, wherein the first end of the audio lead is nondestructively detachable from said carriage means.

22. An earphone as recited in claim 14, wherein the first end of the audio lead is nondestructively detachable from said carriage means by effecting relative movement thereof away from said carriage means in a downward, vertical direction when said earphone is worn by the user.

23. An earphone as recited in claim 14, wherein the exterior of said carriage means is comprised of an injection molded material which is soft and comfortable to the skin.

24. An earphone as recited in claim 23, wherein said material comprises urethane rubber.

25. An earphone as recited in claim 23, wherein said material comprises silicone.

26. An earphone as recited in claim 23, wherein said material comprises vinyl.

27. An earphone as recited in claim 23, wherein said material comprises thermal rubber.

28. An earphone designed for secure carriage on the ear of a user during vigorous activity thereof, said earphone comprising:

(a) an integral, flexible earpiece comprising:

(i) a hook portion curved to fit against the head of the user and over the top of the base of the auricle of the ear, said hook portion having a forward end worn in front of the spine of the helix and a rearward end worn between the scapha and the head;

(ii) a boom portion projecting downwardly and rearwardly from said forward end of said hook portion, said boom portion passing above the tragus when said earpiece is worn by a user and terminating in a remote end at the concha; and (iii) a curved brace portion depending downwardly from said rearward end of said hook portion between the scapha and the head, said brace portion conforming closely with the back surface of the base of the auricle and terminating in a remote end in contact with the back surface of the base of the auricle between the earlobe and the head;

(b) a light-weight audio speaker supported at said remote end of said boom portion intimately within the concha when said earphone is worn by a user; and (c) audio signal transfer means for electrically coupling said speaker to an audio signal source at a location on said earpiece below the earlobe between the earlobe and the head.

29. An earphone as recited in claim 28, wherein said audio signal transfer means comprises:

(a) a modular electrical connector matingly coupleable with an audio lead and supported from said remote end of said brace portion; and (b) an electrical conductor longitudinally disposed within said earpiece extending from said remote end of said boom portion to said remote end of said brace portion, said electrical conductor being electrically coupled at opposite ends thereof to said speaker and to said electrical connector supported from said brace portion, respectively.

30. An earphone as recited in claim 29, wherein said earpiece further comprises stress directionalizing means for preventing downward tension on said connector from twisting said earpiece out of position on the ear of the user.

31. An earphone as recited in claim 30, wherein said stress directionalizing means comprises an arc portion of said earpiece disposed between said electrical connector and said remote end of said brace portion, said arc portion departing radially outwardly in the plane of said brace portion from the curvature of said brace portion and having said electrical conductor disposed therewithin, thereby to downwardly support said electrical connector below the earlobe in a generally vertical orientation between the earlobe and the head, when said earphone is worn by the user.

32. An earphone as recited in claim 31, wherein said earpiece further comprises safety means to flexibly absorb stress imposed on said electrical connector by an audio lead matingly coupled therewith.

33. An earphone as recited in claim 32, wherein said safety means comprises a housing encircling said electrical connector at the end thereof adjacent said arc portion of said earpiece, said housing having an outer surface with a diameter greater than the diameter of the outer surface of said arc portion.

34. An earphone as recited in claim 33, wherein said outer surface of said housing comprises a plurality of upstanding ridges.

35. An earphone as recited in claim 34, wherein said plurality of ridges encircle said housing.

36. An earphone as recited in claim 28, further comprising a cover for said speaker.

37. An earphone as recited in claim 36, wherein said cover is comprised of foam rubber.

38. An earphone as recited in claim 28, wherein said speaker is non-destructively disconnectable from said said earpiece.

39. An earphone as recited in claim 38, wherein said earpiece further comprises:

(a) a modular electrical connector matingly coupleable with said speaker and supported from said remote end of said boom portion; and (b) an electrical conductor longitudinally disposed within said earpiece extending from said remote end of said boom portion to said remote end of said brace portion, said electrical conductor being electrically coupled at one end thereof to said electrical connector supported from said boom portion.

40. An earphone as recited in claim 39, wherein said earpiece further comprises a housing encircling said electrical connector supported from said boom portion at the end said electrical connector adjacent said boom portion of said earpiece, said housing having an outer surface with a diameter greater than the diameter of the outer surface of said boom portion.

41. An earphone as recited in claim 40, wherein said outer surface of said housing comprises a plurality of upstanding ridges encircling said housing.

42. An earphone as recited in claim 28, wherein said speaker is permanently connected to said boom portion of said earpiece.

43. A personal audio system for use with an audio signal source, said system comprising:

(a) an earphone designed for secure carriage on the ear of a user during vigorous activity thereby, said earphone comprising:

(i) a light-weight audio speaker;

(ii) an ear-mountable speaker support ergonomically tailored to cradle the ear of the user, said speaker support comprising a flexible open loop, formed substantially in a single plane, said loop being so sized and configured as to rest freely against the head conforming to the shape of the base of the auricle with said plane of said loop being generally parallel to the head free of forces urging said loop away from the head, said loop extending without significant resilient deformation within said plane of said loop from a first end thereof worn behind the earlobe in snug engagement with the back of the concha to a second end supporting said speaker and worn at the concha, said open loop between said first and second ends thereof passing about the rear and over the top of the base of the auricle, of the helix, around the front of the spine of the helix, and above the tragus positioning a substantial portion of the length of said open loop behind the scapha interior of the helix; and (iii) an electrical conductor longitudinally disposed within said speaker support extending from said first to said second end thereof, said electrical conductor being electrically coupled a first end thereof to said speaker and having a second end opposite therefrom;

(b) a tab projecting from each of said open loop between the scapha and the head in a plane parallel to the head of the user in a direction away from the back surface of the base of the auricle when said pair of earphones is worn by the user; and (c) an audio lead electrically interconnectable at a first end thereof with said second end of said electrical conductor and at a second end opposite thereto with the audio signal source.

44. A system as recited in claim 43, wherein said first end of said audio lead is nondestructively disconnectable from said electrical conductor.

45. A system as recited in claim 44, wherein said earphone further comprises a modular electrical connector coupled to said second end of said electrical conductor and supported from said first end of said open loop for selective coupling with said first end of said audio lead.

46. A system as recited in claim 45, wherein said speaker support further comprises an arc portion disposed between said first end of said open loop and said electrical connector, said arc portion departing radially outwardly in the plane of said open loop from the curvature thereof, thereby to downwardly support said electrical connector behind the earlobe in a generally vertical orientation is worn by the user.

47. A system as recited in claim 46, wherein said speaker support further comprises an elongated cylindrical section of a self-sustaining flexible material embedded in said speaker support encircling at least a portion of the length of electrical conductor, said flexible material being deformable under an externally imposed stress and being capable of retaining the shape into which said flexible material is thereby deformed.

48. A system as recited in claim 46, wherein said earphone further comprises a housing encircling said electrical connector at the end thereof adjacent said arc oil portion of said earpiece, said housing having an outer surface with a diameter greater than the diameter of the outer surface of said arc portion.

49. A system as recited in claim 43, wherein said first end of said audio lead is permanently connected to said electrical connector.

50. A personal audio system for use with an audio signal source, said system comprising:

(a) a pair of earphones, each of said earphones being designed for secure carriage individually on a respective ear of a user during vigorous activity thereby, said earphone comprising:

(i) a light-weight audio speaker;

(ii) an ear-mountable speaker support ergonomically tailored to cradle the ear of the user, said speaker support comprising a flexible open loop, formed substantially in a single plane, said loop being so sized and configured as to rest freely against the head conforming to the shape of the base of the auricle with said plane of said loop being generally parallel to the head free of forces urging said loop away from the head, said loop extending without significant resilient deformation within said plane of said loop from a first end thereof worn behind the earlobe in snug engagement with the back of the concha to a second end supporting said speaker and worn at the concha, said open loop between said first and second ends thereof passing about the rear and over the top of the base of the auricle, around the front of the spine of the helix, and above the tragus positioning a substantial portion of the length of said open loop behind the scapha interior of the helix; and (iii) an electrical conductor longitudinally disposed within said speaker support extending from said first to said second end thereof, said electrical conductor being electrically coupled a first end thereof to said speaker and having a second end thereof opposite therefrom;

(b) a tab projecting from each of said open loops between the scapha and the head in a plane parallel the head of the user in a direction away from the back surface of the base of the auricle when said pair of earphones is worn by the user; and (c) a pair of audio leads in one-to-one relationship with said earphones, each of said audio leads being electrically interconnectable at a first end thereof with a respective one of said second ends of said electrical conductors and at a second end opposite thereto with the audio signal source.

51. A system as recited in claim 50, wherein said pair of audio leads is embedded in a Y-cord connector.

52. A system as recited in claim 51, wherein each of said first ends of said audio leads is nondestructively disconnectable from each of said respective ones of said electrical conductors.

53. A system as recited in claim 50, wherein said first ends of each of said audio leads is permanently connected to each of said respective ones of said electrical conductors.

54. An earphone for use with an audio lead from an audio signal source and designed for secure carriage on the ear of a user during vigorous activity thereof, said earphone comprising:

(a) a light-weight audio speaker;

(b) an ear-mountable speaker support ergonomically tailored to cradle the ear of the user, said speaker support comprising:

(i) a flexible open loop so sized and configured as to extend without significant resilient deformation from a first end worn behind the earlobe in snug engagement with the back surface of the concha to a second end supporting said speaker and worn at the concha, said open loop between said first and second ends thereof passing about the rear and over the top of the base of the auricle, around the front of the spine of helix, and above the tragus positioning a substantial portion of the length of said open loop behind the scapha interior of the helix; and (ii) audio signal transfer means for electrically coupling said speaker to the audio signal source at a location on said speaker support below the earlobe between the earlobe and the head.

* * * * *

UNITED STATES PATENT AND TRADEMARK OFFICE

CERTIFICATE OF CORRECTION

PATENT NO. : 5,412,736

DATED : May 2, 1995

INVENTOR(S) : SHAWN P. KELIILIKI

It is certified that error appears in the above-indentified patent and that said Letters Patent is hereby corrected as shown below:

Column 1, line 27, delete "in"
Column 1, line 60, "light-weight" should be --lightweight--
Column 1, line 62, "a audio" should be --an audio--
Column 2, line 46, "resistent" should be --resistant--
Column 5, line 27, "effected" should be --affected--
Column 6, line 44, delete "are"
Column 7, line 23, before "FIG. 4" insert --shown in--
Column 9, line 11, after "structures" insert --are--
Column 9, line 31, "potion" should be --portion--
Column 10, line 31, "ill" should be --in--
Column 12, line 17, delete "in"
Column 14, line 58, change "the" to --an--
Column 17, line 34, delete "said"
Column 17, line 50, after "end" insert --of--
Column 18, line 63, delete "oil"
Column 18, line 25, "loop" should be --loops--

Signed and Sealed this

Eighth Day of August, 1995

*Attest:*

Bruce Lehman

BRUCE LEHMAN

*Attesting Officer*

*Commissioner of Patents and Trademarks*